US011078439B2

(12) United States Patent
Pelto-Huikko et al.

(10) Patent No.: US 11,078,439 B2
(45) Date of Patent: Aug. 3, 2021

(54) PASTE TYPE LUBRICATION

(71) Applicant: KONE CORPORATION, Helsinki (FI)

(72) Inventors: Raimo Pelto-Huikko, Helsinki (FI); Anssi Laukkanen, Helsinki (FI); Kenneth Holmberg, Helsinki (FI); Timo Hakala, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 16/850,515

(22) Filed: Apr. 16, 2020

(65) Prior Publication Data

US 2020/0239808 A1 Jul. 30, 2020

Related U.S. Application Data

(63) Continuation of application No. PCT/FI2018/050801, filed on Nov. 2, 2018.

(30) Foreign Application Priority Data

Dec. 15, 2017 (FI) ..... 20176129

(51) Int. Cl.
*C10M 171/06* (2006.01)
*C10M 125/10* (2006.01)
(Continued)

(52) U.S. Cl.
CPC ..... *C10M 171/06* (2013.01); *C10M 125/10* (2013.01); *C10M 169/04* (2013.01);
(Continued)

(58) Field of Classification Search
CPC ..... C10N 2040/32; C10M 171/06; C10M 169/04; C10M 125/10; C10M 2201/062
See application file for complete search history.

(56) References Cited

U.S. PATENT DOCUMENTS 3,899,365 A * 8/1975 Guy ..... D07B 1/06 148/250
5,919,295 A * 7/1999 Lamba ..... C09K 3/149 106/36

(Continued)

FOREIGN PATENT DOCUMENTS

CN 105219486 A 1/2016
EP 1 688 384 A2 8/2006

(Continued)

OTHER PUBLICATIONS

International Search Report issued in PCT/FI2018/050801 (PCT/ISA/210), dated Feb. 12, 2019.

(Continued)

*Primary Examiner* — Ellen M McAvoy
(74) *Attorney, Agent, or Firm* — Birch, Stewart, Kolasch & Birch, LLP

(57) ABSTRACT

In a paste type lubrication between a steel wire rope and a rope groove of a pulley, is applied a paste lubricant which contains oil and small solid particles. Solid particles could be of a wide variety sizes and they are small enough to at least partly fit into the valleys between the peaks of surface roughness of the ropes or the rope groove.

20 Claims, 3 Drawing Sheets

Figure 1:
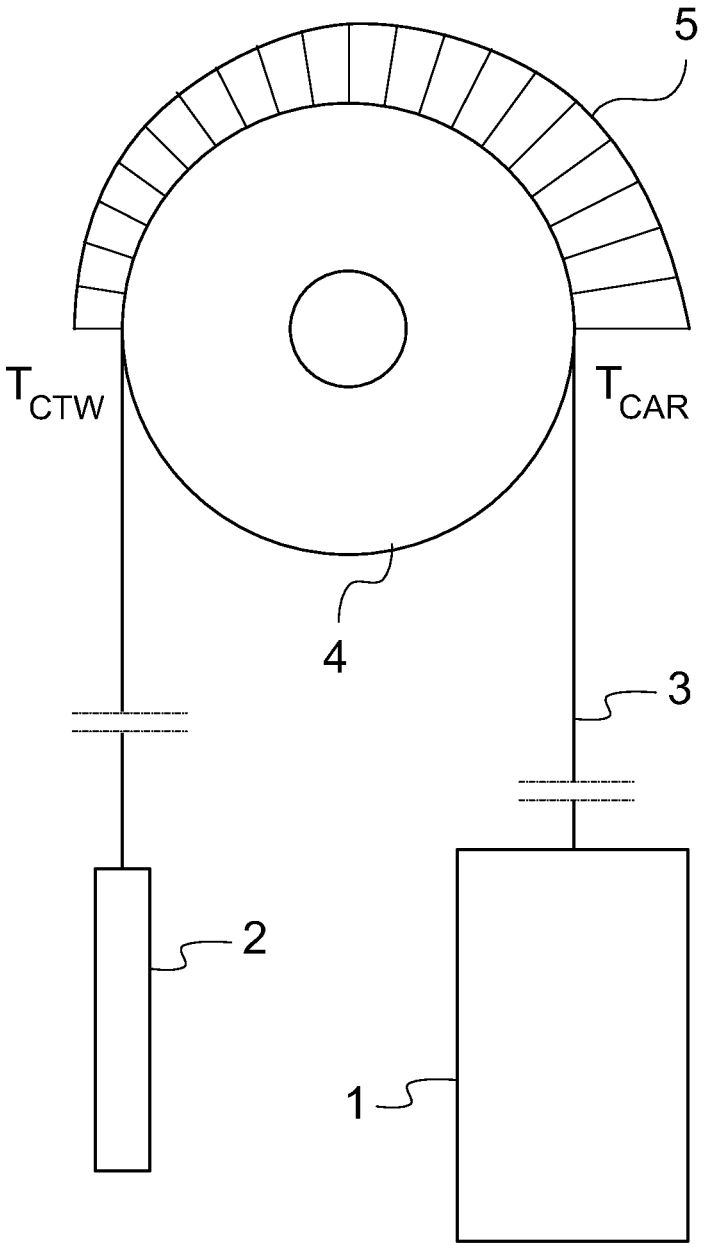

(51) Int. Cl.

| | |
|---|---|
| ***C10M 169/04*** | (2006.01) |
| ***D07B 1/14*** | (2006.01) |
| ***D07B 5/00*** | (2006.01) |
| *B66B 7/12* | (2006.01) |
| *C10N 40/32* | (2006.01) |

(52) U.S. Cl.

CPC ..... *D07B 1/144* (2013.01); *D07B 5/005* (2013.01); *B66B 7/1261* (2013.01); *C10M 2201/062* (2013.01); *C10N 2040/32* (2013.01); *D07B 2205/505* (2013.01); *D07B 2501/2007* (2013.01)

(56) References Cited

U.S. PATENT DOCUMENTS

2008/0161213 A1* 7/2008 Jao ..... B82Y 30/00 508/165
2012/0061188 A1* 3/2012 Aulanko ..... B66B 7/06 187/254
2012/0312637 A1* 12/2012 Aulanko ..... D07B 1/144 187/254
2013/0190441 A1* 7/2013 Vucak ..... C09C 1/021 524/425
2014/0299419 A1* 10/2014 Pelto-Huikko ..... B66B 7/12 187/251
2017/0002285 A1* 1/2017 Hirooka ..... C10M 107/50
2018/0223128 A1* 8/2018 Fruhauf ..... C09D 5/22
2018/0362873 A1* 12/2018 Sasaki ..... C10M 107/44
2019/0330556 A1* 10/2019 Muller ..... C10M 169/02

FOREIGN PATENT DOCUMENTS

| | | | |
|---|---|---|---|
| EP | 3 433 419 | A0 | 2/2019 |
| JP | 2009-234791 | A | 10/2009 |
| JP | 2016-108380 | A | 6/2016 |
| WO | WO 2007/071340 | A1 | 6/2007 |
| WO | WO 2011/144816 | A1 | 11/2011 |
| WO | WO 2016/096395 | A1 | 6/2016 |
| WO | WO 2017/216414 | A1 | 12/2017 |

OTHER PUBLICATIONS

Written Opinion of the International Searching Authority issued in PCT/FI2018/050801 (PCT/ISA/237), dated Feb. 12, 2019.

* cited by examiner

PASTE TYPE LUBRICATION

CROSS REFERENCE TO RELATED APPLICATIONS

This application is a Continuation of PCT International Application No. PCT/FI2018/050801, filed on Nov. 2, 2018, which claims priority under 35 U.S.C. 119(a) to Patent Application No. 20176129, filed in Finland on Dec. 15, 2017, all of which are hereby expressly incorporated by reference into the present application.

The object of the invention is a paste type lubrication between a steel wire rope and a rope groove of a pulley. An incentive of the invention is to seek a paste type lubrication suitable for steel wire ropes used in elevators.

Ropes laid from metal wires, more particularly the hoisting ropes, i.e. suspension ropes, of elevators or other hoisting apparatuses are generally lubricated with some suitable lubricant. Lubrication improves the operation of ropes and reduces the wear of the ropes, in which case the service life of the ropes lengthens. Lubrication also prevents the rusting of ropes. Ropes are usually lubricated in connection with the manufacture of the ropes, e.g. such that a lubricant is spread into the rope structure to be manufactured. Usually elevator ropes are steel wire ropes. A steel wire rope or one or more of the strands of a steel wire rope may comprise a core of a softer material, such as plastic or hemp.

Conventionally the lubricant used in steel elevator ropes is paraffin-based. A problem when using paraffin is, however, when the ropes get hot the structure of the oil thins, in which case the oil bound by the paraffin can easily detach from the rope. Another problem with paraffin-based lubricant is that the traction sheave-rope contact becomes more slippery at a higher temperature, due to which it can be difficult to get the friction factor between the traction sheave and the rope to meet the values required by elevator regulations. If the friction factor is too small, the ropes can slip on the traction sheave, which causes problems and can also be a safety risk. Other relatively thin lubricants have the same type of problems as oil mixed with paraffin.

The solution of the same applicant presented in the international patent publication No. WO2011144816 A1 shows a steel rope with a lubricant that comprises oil and relative high proportion of thickener, which thickener comprises one or more solid additives of a softer material than the steel wires of the rope. The present invention is an advantageous improvement to the solution of the WO publication.

Normally it is desired to make elevators and elevator structures as light as possible, in which case the elevator would be cheaper to manufacture and install. As the elevator car and the counterweight become lighter, however, the friction between the elevator ropes and the traction sheave decreases at the same time. The reduction in friction thus limits the making of lighter elevators; a general aim is to achieve high friction but, however, such that the ropes do not wear too quickly.

The aim of this invention is to eliminate the aforementioned drawbacks and to achieve a steel wire rope, e.g. a suspension rope of a traction sheave elevator, that is lubricated with a lubricating grease type of lubricant, the friction factor between which suspension rope and traction sheave is greater than in existing solutions. In addition, one aim is to achieve a suspension rope of a traction sheave elevator, the service life of which suspension rope is longer than before. Yet another aim is to achieve a suspension rope of a traction sheave elevator in which the lubricant stays on the rope well during the operation of the rope. The aim of the invention is also to achieve a traction sheave elevator, in which the suspension ropes are lubricated with a lubricating grease type of lubricant. Additionally the aim of the invention is to achieve the use of a lubricating grease type of lubricant for lubricating a steel wire rope, such as the suspension rope of an elevator. And a particular aim of the invention is to improve the solution presented in the international patent publication No. WO2011144816 A1.

In the context of this text a grease type of lubricant containing a large proportion solid particles may be called a paste lubricant or a paste type lubricant or other suitable way.

The invention, in its broad form, is a paste type lubrication between a steel wire rope and a rope groove of a pulley, wherein the paste lubricant contains oil and small solid particles, which are not too large to fit in the valleys between the peaks of surface roughness of the ropes or the rope groove. For largest of the particles this means kind of a plug-in fit, so that only part of such a particle penetrates into the valley. The rope groove material could also be non-metallic one, such as polyurethane or nylon.

In a preferred paste type lubrication the paste lubricant is applied in the contact between a steel wire rope and a rope groove of a pulley and the paste lubricant contains particles, oil and possibly other ingredients, the surface structure of steel wires of the steel wire rope comprises wire surface asperity and the surface of rope groove comprises groove surface asperity, the paste lubricant compressed in the space between the steel wires and the rope groove, the particles transmitting at least part of the shear force resulting from the slip between the surface of the rope groove and the surface of the steel wire, wherein particles in the lubricant substantially are smaller than 5 times of Ra-value of the rougher one of the surface structure of steel wires and the surface of rope groove, and wherein at least 80 percent of the total mass of the particles in the lubricant consists of particles larger than 10 percent of Ra-value smoother of the surface structure of steel wires and the surface of rope groove. Ra-value is the arithmetical mean deviation of the assessed profile. Although it would be desirable that the all particles are smaller than intended maximum size, but in practice it is sufficient if the mass of the oversized particles is only 1 or 2 percent of the total mass of the particles.

Important embodiments of the invention are characterized by what is disclosed in claims.

Preferably a major part of the particles in the lubricant are of harder material than the softer one of the surface structure of steel wires and the surface of rope groove.

Preferably a major part of the particles in the lubricant are spherical or almost spherical.

In addition, within applying the invented paste type lubrication, the invention concerns steel wire ropes, elevators with steel wire ropes, lubricants for steel wire ropes and use of lubricant.

A practical application of this invention is to equip an elevator with the type of elevator ropes in which lubricant contains solid additives in form of round or almost round particles or particles having small largest dimension-smallest dimension ratio. The particles preferably are about equal hard as the steel wires in the steel rope or even harder. The solid additives make it possible to achieve friction between the elevator ropes and the traction sheave which friction is greater than with elevator ropes that are lubricated according to prior art.

A further practical application of this invention is to equip an elevator with the type of elevator ropes in which lubricant that contains solid additives that are about equal hard as the steel wires in the steel rope or even harder, is used as a lubricant instead of oil, paraffin or oil mixed with paraffin. The hard additives make it possible to achieve friction between the elevator ropes and the traction sheave which is greater than with elevator ropes that are lubricated according to prior art.

An aspect of the invention relates to a way to lubricate a steel wire rope using a paste type lubricant, which comprises oil and powder substance. Preferably the particles of the powder substance comprised in the lubricant are spheres or chunks or ovals. Advantageously the ratio of the longest dimension to the shortest dimension of a particle, i.e. the internal aspect ratio of the particle, is at most about 5. Preferably the internal aspect ratio is less than 2, more preferably less than 1.5, even more preferably at most about 1.2, most preferably as close to one as possible. In an ideal powder substance all or almost all particles are spheres or nearly spheres, thus resulting the average aspect ratio at most about 1.2.

Preferably the essential or main part of the particles of the powder substance are of hardness about equal or greater than that of the steel wires of the rope. In all lubricants according to the invention the hardness of main part of the particles of the powder substance is at least 4 on the Mohs scale.

Advantageously the particles in the lubricant are slightly elastic allowing minor deformation. In a preferred embodiment the elastic modulus of the particles is in the range from 50 GPa to 420 GPa, more preferably in the range from 70 GPa to 200 GPa and even more preferably in the range from 80 GPa to 160 GPa.

In a preferred embodiment, the lubricant contains very fine particles, which help to form force bridges between the bigger particles. For example the lubricant could contain more percent of the total mass of the particles such which are smaller than one tenth (1/10) of Ra-value of the smoother one of the surface structure of steel wires and the surface of rope groove. As an other example, the lubricant could contain more 3-20 percent of the total mass of the particles, smaller than 0.3 μm or even smaller than 0.1 μm.

It is also advantageous to mix to the powder material of the lubricant small amount of rod or flake shaped particles, as they would block mutual movement of the spherical or almost spherical particles and thus increasing friction in the lubrication.

Suitable powder materials are for example $Mn_3O_4$ and $MnO_2$, but other powder materials having about similar characteristics are suitable, too. Glass beads or glass spheres are suitable for powder particles. Powder materials may also consist of or comprise round ceramic particles. Aluminium oxide spheres are available in a suitable sizes to fit in surface asperity and they could be used as solid particles of the lubricant at least in mixtures of the particles.

Preferably the powder material does not bind water in or on its particles. Advantageous powder materials are rather hydrophobic ones than hydrophilic ones.

Advantageously the particles of the lubricant of the invention are in range of suitable sizes and of suitable hardness so that, when the lubricant and the particles in the lubricant spreads as a layer between the roughness topographies of the surfaces of the wire rope and pulley, the particles separate the surfaces substantially from each other and the shear work caused from the slip between the surfaces occurs mostly between the particles. For particles of suitable sizes and of suitable hardness there is no essential risk disturbing amount of particle breakages, at least in conditions between an elevator wire rope and a pulley, such as a traction sheave of an elevator. As the direct contact between the surfaces is minimized, the wear of the surfaces is essentially reduced. However, due to the shear work in the lubricant, increased friction between the surfaces is achieved.

Advantageously Ra-value of roughness of the lubricated surfaces is in range 0.3-2.5 μm, preferably in range 0.8-1.6 μm. Advantageous particle hardness on the Mohs scale is in range 4-7.

The advantageous particle size in the lubricant is in range 0.1-8 μm, and advantageously particles of the lubricant are of different sizes. Advantageously the median of the particle size distribution is in range 0.3-4 μm, more advantageously in range 1-3 μm.

The lubricant may contain small proportion also much larger particles than the advantageous ones. In a preferred embodiment, the mass portions as function of the particle size follows Weibull distribution or normal distribution. Weibull distribution is particularly suitable in cases were the distribution of particle sizes is wide. In case of a mix of two powder material sets, the particle distribution may be two peak distribution.

An advantageous way to practice the invention is to apply the invention in connection with elevator ropes or their lubrication. A clear advantage is improved traction between the iron or steel traction sheave and steel wire ropes used as hoisting ropes. An advantage is also the extended lifetime of such hoisting ropes. The same advantages are reached also in connection of using rubber, polyurethane or corresponding material coated traction sheaves to drive the hoisting ropes. The traction sheave coating type could be for example like coatings disclosed in the embodiments of EP 1688384 A2.

Today a major part of the ropes used in elevators are in range of tensile strength between 1370 $N/m^2$ and 1960 $N/m^2$. Ropes made of steel wires of higher tensile strength are also used in elevators, particularly in case of elevators applying hoisting ropes thinner than 8 mm.

Preferably the lubricant comprises at least oil and more than 50% of the weight of the lubricant solid powder substance that acts as thickener. The thickener comprises one or more solid additives in small particles that are about as hard as the metal wires of the rope or harder, and preferably the thickener is non-organic.

Simple way to make lubricant is to mixing its ingredients with each other. A recipe for mixing ingredients of the lubricant may vary in range of following:

5-40%, preferably 15-30%, most preferably approx. 20% oil and 60-95%, preferably 70-85%, powder substance and 0-5%, preferably 0.2-3%, suitably approx. 0.3-0.6%, e.g. 0.4% binder agent. These percentage figures are percentages by weight. Owing to the large amount of powder substance, the structure of the lubricant is a paste. Depending on how fine the powder material is, the preferred oil amount could be different, finer the powder material is, more oil it can absorb.

Advantageously in the lubricant of the invention a thickener comprising one or more solid additives is mixed to the oil a large enough proportion, so that the mixture of the oil and thickener forms a paste.

Advantageously, in practical lubricant recipes according to the invention, the amount of the oil compared to the amount of the powder substance is greater than the oil absorption of the powder substance in question. In case of mix of two or more powder substance, the minimum oil amount is defined separately for each powder substance component. For the determination of oil absorption value the International Standard ISO 787/5 can be followed.

The powder substance should be rather fine. Advantageously the particle size is below 75 μm. Preferably at least 50% of mass of the powder substance belongs to the particle size range from 1 to 10 μm.

Advantageously the lubricant also contains a small amount of binder agents, for example about 0 to 10% of the weight of the lubricant. Other additives may also be used, for example such ones improving storage properties.

An aspect of the invention is to lubricate metal ropes, in practice steel wire ropes, which possibly contain non-metal parts.

Preferably, the invention is applied in relation with a traction sheave elevator in which the traction sheave has metal contact surface, preferably steel or cast iron, for carrying the lubricated rope. The elevator could be alternately constructed so that the traction sheave contact surface carrying the lubricated rope is non-metallic, such as a surface of a poly-urethane coating implemented on the traction sheave.

Another aspect of the invention is a traction sheave elevator, comprising at least an elevator car, possibly a counterweight and a plurality of suspension ropes, comprising one or more strands composed of steel wires, which ropes are led to pass over a traction sheave provided with a hoisting machine and which suspension ropes are lubricated with a lubricant that comprises at least oil. The lubricant of the suspension ropes of the traction sheave elevator according to the invention is in a form of paste and the powder substance in the lubricant comprises particles whose hardness is greater preferably than 4 on the Mohs scale.

In addition, a suitable powder substance comprises particles whose hardness is about equal to the hardness of the steel of the wires of the strands of suspension ropes, or greater than the hardness of the steel of the wires of the strands of suspension ropes.

Still another aspect of the invention is a rope lubricant for a steel wire rope, which rope comprises one or more strands composed of steel wires. The rope lubricant comprises oil and powder substance, which powder substance in the lubricant comprises particles whose hardness is greater than 4 on the Mohs scale.

Yet another aspect of the invention is a use of the aforementioned lubricant for lubricating a rope, e.g. a steel rope, that contains metal as a load-bearing material.

One advantage, among others, of the solution according to the invention is that the friction between the elevator ropes and the rope grooves of the traction sheave is greater than with conventional oil- or grease-lubricated elevator ropes. Another advantage is that, as a result of the better friction on the traction sheave, the slip control of the elevator ropes on the traction sheave also improves. From the advantages presented above follows the advantage that the torque of the motor can be utilized more efficiently, as the ratio of the rope forces on different sides of the traction sheave can be made greater, which enables an improvement of the ratio of the net useful load and the deadweight of the car. A further advantage is that the greater friction allows a smaller diameter of the traction sheave, or correspondingly a smaller contact angle of the elevator ropes and the traction sheave. One advantage is also that, owing to the better friction, smaller and lighter structures can be used in the elevator, which also results in a reduction of costs. An additional advantage is that the elevator ropes do not rust or wear easily, so consequently the lifetime of the rope is much longer compared e.g. to a rope lubricated with paraffin. Another advantage is that the lubricant penetrates inside the rope very well and stays attached to the rope well, and does not detach from it easily or splash into other parts of the elevator.

A further advantage is that with the invention the service life of the rope is longer than with ropes lubricated with conventional methods. One important aspect of the invention is that the friction factor between the traction sheave and the rope is sufficiently large owing to the amount of lubrication being correct and the lubricant having a friction factor higher than that of paraffin. Thus the rope does not slip on the traction sheave in the operating conditions of the elevator. A further advantage is that the lubricant stays tightly on the rope and does not detach from it easily, e.g. from the effect of centrifugal force, even if the rope becomes very warm. In this case higher speeds can be used safely. A further advantage is that the arrangement is simple and inexpensive to implement. Still a further advantage is that substantially hard particles and round or spherical shape of the particles in the powder substance of the lubricant make the particles act as a ball bearing for the microscale movement between rope wires. In the presence of typical rope forces the particles in the lubricant are not crushed. The hard, round shaped particles in the lubricant also prevent the opposing surfaces to touch each other.

Preferably particles of the lubricant or at least a significant proportion of the particles are of such size and having a suitable size distribution so that single particles or agglomerations of the particles would create temporary force paths between the asperities of the rope surface and rope groove, such force paths resisting relative sliding in the rope groove-rope contact and thus improving friction. Suitably a significant proportion of the particles are of size about the same or larger than depth of the asperities.

Preferably large particles in the lubricant are about or at most of length of asperities. Larger particles than length of the asperities are rare or do not appear in the powder material of the lubricant.

As the particles in the lubricant increase number of the force paths between rope and rope groove, local surface stress is reduced.

However, for increasing the total surface are of the particles, it is advantageous that there are different particle sizes in the lubricant. Even smaller particles than depth of the asperities could be present in the lubricant.

Ropes, more particularly steel ropes that are lubricated with a lubricant comprising solid substances, such as grease, a grease compound or paste or corresponding, are also within the scope of the inventive concept. The lubricating is performed preferably onto a wire or strand of the rope before closing the lay structure of the rope.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise, the different details presented in connection with each embodiment of the invention can also be applied in other embodiments. In addition, it can be stated that at least some of the subordinate claims can at least in suitable situations be deemed to be inventive in their own right.

Figure 2:
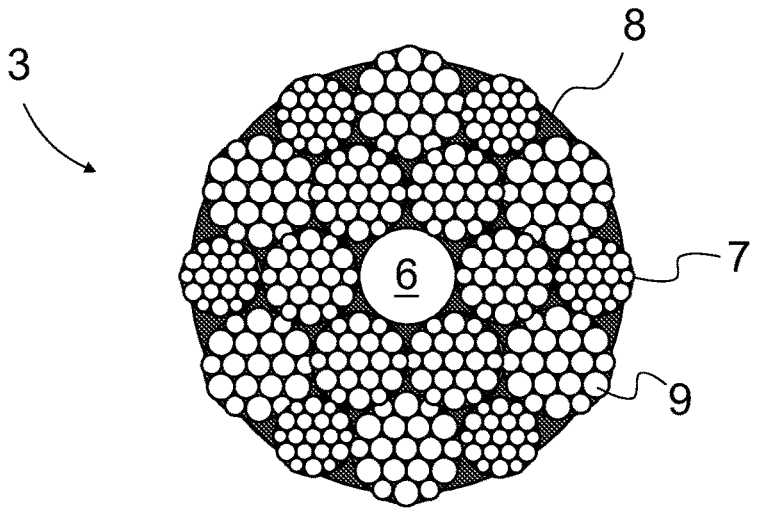
Figure 3:
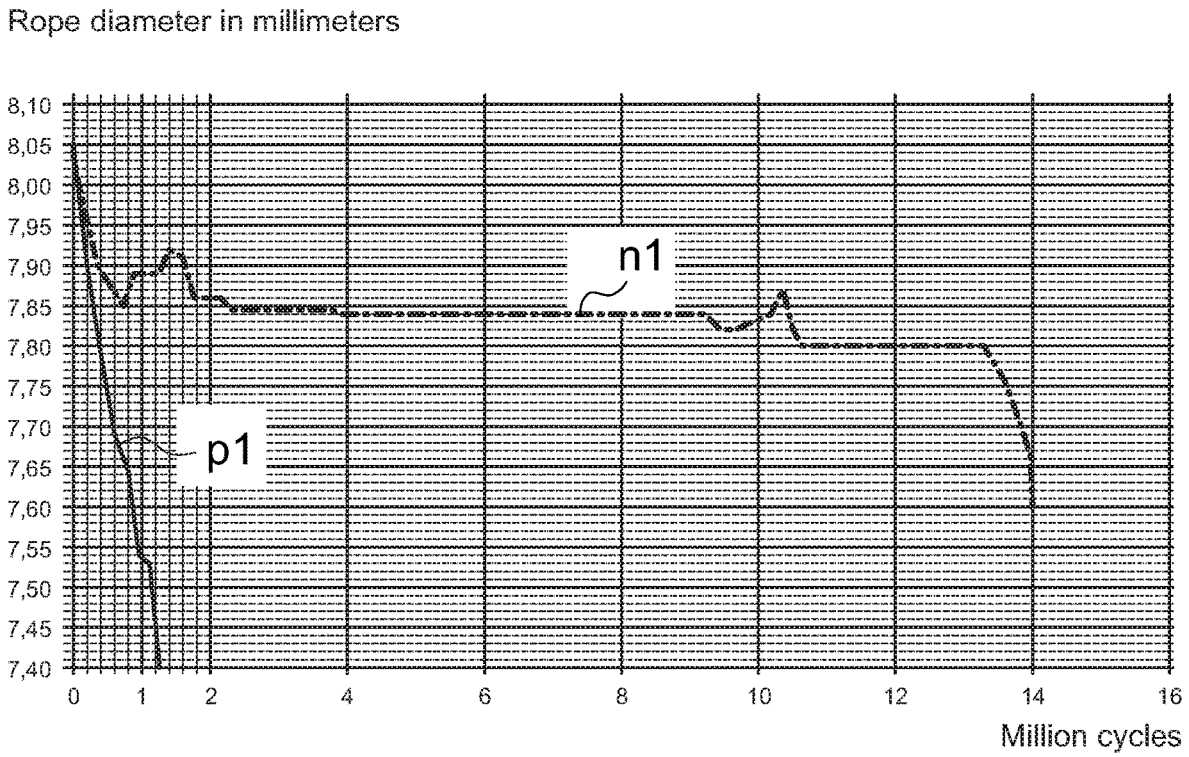
Figure 4:
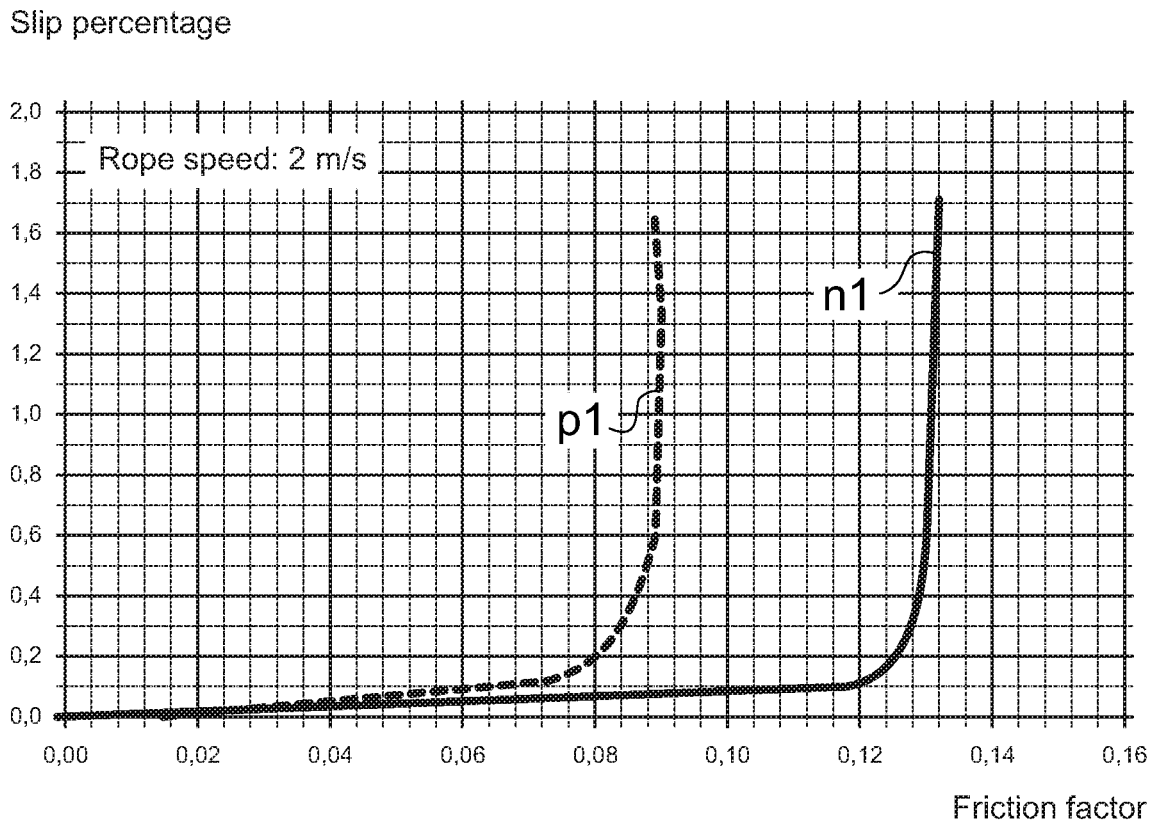
Figure 5:
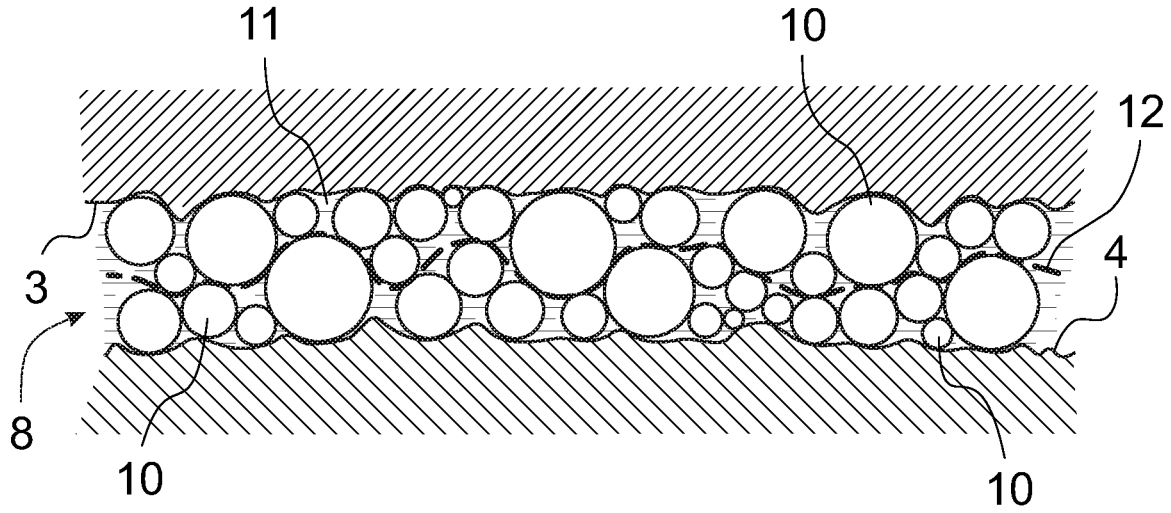

In the following, the invention will be described in detail by the aid of an example of its embodiment with reference to the attached drawing, wherein FIG. 1 presents a diagrammatic and simplified view of a traction sheave elevator with its rope tension chart as viewed from the side of the traction sheave, FIG. 2 presents a cross-section of one metal rope, such as a suspension rope of an elevator, lubricated with a lubricant, FIG. 3 presents a graph, compiled on the basis of measurement results, of the wearing of an elevator rope lubricated according to the invention, FIG. 4 presents a graph, compiled on the basis of measurement results, of the ratio of the slip percentage of two elevator ropes lubricated in different ways and also of the friction factor between the elevator rope and the rope groove, and FIG. 5 presents an enlarged cross-section of a metal rope, such as a suspension rope of an elevator, in a rope groove of a traction sheave, and lubricated with a lubricant according to the invention.

FIG. 1 presents a diagrammatic and simplified view of a typical traction sheave elevator, which comprises an elevator car 1, a counterweight 2 or balance weight and, fixed between these, elevator roping formed of elevator ropes 3 that are parallel to each other. The elevator ropes 3 are guided to pass over the traction sheave 4 rotated by the hoisting machine of the elevator in rope grooves dimensioned for the elevator ropes 3. As it rotates, the traction sheave 4 at the same time moves the elevator car 1 and the counterweight 2 in the up direction and down direction, due to friction.

Owing to the difference between the counterweight 2 and the elevator car 1 plus the load at any given time in the car, the rope forces $T_{CTW}$ and $T_{CAR}$ exerted on the elevator ropes 3 are of different magnitudes on different sides of the traction sheave 4. When the elevator car 1 contains less than one-half of the nominal load, the counterweight is generally heavier than the elevator car 1 with load. In this case the rope force $T_{CTW}$ between the counterweight 2 and the traction sheave 4 is greater than the rope force $T_{CAR}$ between the elevator car 1 and the traction sheave 4. Correspondingly, when the elevator car 1 contains over one-half of the nominal load, the counterweight 2 is generally lighter than the elevator car 1 with load. In this case the rope force $T_{CTW}$ between the counterweight 2 and the traction sheave 4 is smaller than the rope force $T_{CAR}$ between the elevator car 1 and the traction sheave 4. In the situation presented in FIG. 1, the rope force between the elevator car 1 and the traction sheave 4 is $T_{CAR}>T_{CTW}$. As a consequence, the rope tension acting on the elevator ropes 3 that is produced by the rope forces $T_{CTW}$ and $T_{CAR}$ in the rope grooves of the traction sheave 4 is not constant, but instead increases when going from the counterweight 2 side to the elevator car 1 side. This growing rope tension is diagrammatically presented in the tension chart 5 drawn in FIG. 1. As explained earlier, this tension difference tries to cause slipping of the elevator ropes 3 in the rope grooves. It is endeavored to compensate for the tension difference across the traction sheave 4 with a controlled slip, which can be implemented e.g. owing to the larger friction.

FIG. 2 presents a cross-section of a metal rope, such as a suspension rope 3 of an elevator for suspending and moving the elevator car. The suspension rope 3 of the elevator comprises strands 7 laid together around a core 6, which strands 7 for their part are laid e.g. from metal wires, such as from steel wires 9. The elevator rope 3 is lubricated with a lubricant 8 in connection with the manufacture of the rope. The lubricant 8 is between the strands 7 and also between the wires 9 of the strands, and the lubricant 8 is arranged to protect the strands 7 and the wires 9 from rubbing against each other. The lubricant 8 of the elevator rope 3 according to the invention also acts on the friction factor between the elevator rope 3 and the traction sheave 4 of the elevator, increasing the friction compared to elevator ropes lubricated with lubricating oil or lubricating grease according to prior art.

The lubricant 8 of a suspension rope 3 of an elevator according to the invention comprises at least some base oil suited to the purpose, some thickener, i.e. solid powder-like additive, that is preferably non-organic, and later referred as "powder substance", and also if necessary some binder agent, such as poly-isobutene or some other suitable organic compound. The base oil, more briefly referred to as "oil", is e.g. some suitable synthetic oil that contains various additives, such as e.g. wear resistance agents and corrosion resistance agents. The task of the oil is, among other things, to prevent water from entering the rope 3 and to protect the rope from corrosion and wear. Anti-fretting and possibly also anti-seize types of lubricants are applicable to the purpose according to the invention as a lubricant of an elevator rope 3, even though there are restrictions caused by the application.

The powder substance of the lubricant 8 comprises one or more fine-grained solid substances comprising small particles of different sizes. At least a part of the particles, preferably a majority of the particles are suitably hard. The hardness of those particles on the Mohs scale is about equal to the hardness of the steel of the wires 9 of the rope, or greater than the hardness of the steel of the wires 9. Preferably the solid powder substances belong to the spinel group of minerals where common crystal forms are cubic or isometric, for instance octahedral.

Steel wires most usually used in elevators belong to strength classes 1370 $N/m^2$, 1570 $N/m^2$, 1770 $N/m^2$ and 1960 $N/m^2$, where the strength is calculated as nominal tensile strength. However, even stronger steel wires are used. Commercial elevators are provided even with steel wires whose nominal tensile strength is between 2000-3000 $N/m^2$. Usually stronger steel wires are also harder than steel wires with smaller strength.

The particles in the powder substance have a high specific weight. Thus, the specific weight of the particles is many times greater than the specific weight of the used oil. For that reason, the particles tend to descent onto the bottom of lubricant 8 at least in a long term storage. Preferably the lubricant 8 comprises additives that slow that kind of precipitation down or even prevent it.

The binder agent is arranged to keep the other materials of the lubricant 8, i.e. the oil, and the powder substance better together. The binder agent is e.g. an organically-based mass, such as a butene compound or some other substance suited to the purpose, e.g. a resin-based or wax-based substance.

The lubricant 8 is manufactured simply by mechanically mixing its different constituent parts with each other. The mixing ratios of the different constituents of the lubricant 8 are e.g. approx. 10-40%, preferably approx. 15-30%, suitably approx. 20%, oil; e.g. approx. 60-95%, preferably approx. 70-85%, powder substance; and e.g. approx. 0-5%, preferably approx. 0.2-3%, suitably approx. 0.3-0.6%, e.g. 0.4%, binder agent. The aforementioned percentage figures are percentages by weight. Owing to the large amount of powder substance, the structure of the lubricant 8 is a paste. With the help of the binder agent and powder substance, the lubricant 8 stays on the rope well and does not detach easily.

The lubricant 8 according to the invention differs from conventional lubricating grease in that, among other things, preferably the lubricant comprises a very high proportion of powder substance and less oil. The powder substance can account for e.g. at most 95%, in which case the proportion of base oil remains at 5% at the highest. Whereas with lubricating greases according to prior art the proportion of base oil in the grease is 80-90%, in which case the proportion of powder substance and other substances remains only at 10-20%.

FIG. 3 presents a graph compiled on the basis of the measurement results obtained in tests, of the wearing of elevator ropes lubricated in different ways. The curve p1 presents a rope lubricated with paraffin according to prior art, and the curve n1 presents a rope lubricated with the lubricant 8 according to the invention. The wearing of the ropes was tested with test equipment such that the rope was driven back and forth in a groove of a rope sheave and wearing of the rope was diagnosed from the reduction in diameter of the rope.

Both the ropes had the nominal diameter of 8 mm. The rejection limit in the tests was set to the value where the diameter of the ropes had become 6% thinner from the nominal diameter. In that case the rejection limit was 8*0.94=7.52 millimeters.

It can be seen from FIG. 3 that the rope p1 that were originally about 8.05 mm thick and lubricated with paraffin-based lubricant has thinned after approx. one million test cycles to become 7.54 millimeters thick in its diameter. The rejection limit 7.52 millimeters was reached before 1.2 million test cycles. Then the rope p1 seems to have essentially lost its fitness for purpose. On the other hand, the rope n1 that was lubricated with the lubricant 8 according to the invention has not really worn at all after the initial operational period even during the 10 million test cycles and is fit for use up till about 14 million test cycles. This is about 12 times more than with the rope p1.

FIG. 4 presents a graph, compiled on the basis of the results of measurements made in a laboratory, of the relationship between the friction factor of the rope groove of the traction sheave 4 and the slip percentage of a steel rope p1 lubricated with a paraffin-based lubricant according to prior-art and a steel rope n1 lubricated with the lubricant 8 according to the invention. The case shown here is thus the empirically obtained effective friction factor between two objects that slide against each other, and not the specific friction factor for an individual material.

It can be seen from the graph that in the case of a steel rope lubricated with a paraffin-based lubricant according to prior art, which is represented by the curve p1 in FIG. 4, the effective friction factor rises linearly and relatively fast in the initial phase of slip. When the slip is approx. 0.2%, the increase in the effective friction factor has slowed down, being in this phase now approx. 0.08. After this when the slip increases, the rise in the effective friction factor slows down even faster and does not increase over the approx. 0.09 limit here, even if the slip were to grow more. In this case, the situation is that the grip of the elevator rope in the groove of the traction sheave 4 has been lost.

Correspondingly, in the case of a steel rope lubricated with the lubricant 8 according to the invention, which is represented by the curve n1 in FIG. 4, the effective friction factor again rises linearly and relatively fast in the initial phase of slip. As the slip increases, the effective friction factor now also continues its increase, essentially linearly to a higher value of effective friction factor than with the rope represented by the curve p1. With the rope n1 lubricated with the lubricant 8 according to the invention, as the slip increases, the effective friction factor reaches a value of about 0.13. In this case considerably more grip reserve remains for the traction sheave 4 in case of unexpected situations, and larger values than 0.1, e.g. values about 0.13, can be used for the effective friction factor in the dimensioning. This enables a higher ratio $T_{CAR}/T_{CTW}$ of rope forces, in which case it is possible to achieve smaller moving masses, a further consequence of which is smaller acceleration forces, lower energy consumption and smaller losses.

In addition, savings can be made in materials. Instead of making the elevator car lighter the better friction factor or friction grip can be utilized in several ways. For instance, it is not necessary to reduce acceleration because of slipping, and in addition it is possible to reduce under cutting in rope grooves and to increase rope force because surface pressure is now not a hindrance. That means in practice that the number of suspension ropes 3 can be reduced. And further, the better working lubrication makes it possible to use smaller rope pulleys.

FIG. 5 presents a greatly enlarged cross-section of a metal rope, such as a steel suspension rope 3 of an elevator, in a rope groove of a traction sheave 4, and lubricated with the lubricant 8 according to the invention. As mentioned earlier the lubricant 8 comprises a special powder substance that is powder like and comprises small solid particles 10 of different sizes. Preferably the particles 10 are rather round, advantageously in form of a sphere or chunk or an oval. Advantageously the ratio of the longest dimension to the shortest dimension of the particle 10 is close to one. This ratio is called the internal aspect ratio as mentioned earlier.

Besides the round or almost round shape, the hardness of at least a part of the particles 10, preferably a majority of the particles 10 on the Mohs scale is about equal to the hardness of the steel of the wires 9 of the rope, or greater than the hardness of the steel of the wires 9. One possible type of substances to be used are solid substances belonging to the spinel group of minerals which have crystal forms that are cubic or isometric, for instance octahedral, and therefore the particles of these substances can approximately resemble spherical particles. For example, classified manganese (II, III) oxide, $Mn_3O_4$, is a substance that can be used as a powder substance in the lubricant 8 according to the invention. The hardness of $Mn_3O_4$ on the Mohs scale is about 5.5, which value corresponds to the hardness of the cutting edge of a good carbon steel blade of a knife.

It is also possible that manganese (IV) oxide or manganese dioxide, $MnO_2$ is used as a powder substance in the lubricant 8 according to the invention. The hardness of $MnO_2$ on the Mohs scale is about 5. In that case the hardness of $MnO_2$ is also greater than the hardness of the steel of the most commonly used wires 9.

Preferably the hardness of the particles 10 of the main substance of the powder substance is greater than 4, for instance between 4 and 6, and suitably between 5 and 5.5 on the Mohs scale.

FIG. 5 shows in a greatly enlarged view how the mainly round or almost round solid particles 10 of the powder substance in the lubricant 8 are located between the surfaces of the suspension rope 3 and the rope groove of the traction sheave 4. Between the solid particles 10 the lubricant 8 has synthetic oil 11 and binder agents, the amounts of them has been mentioned earlier. The thickness of the layer of the particles 10 between the two adjacent steel surfaces is greater than the surface roughness of each of the steel surfaces. In that case the particles 10, being harder or at least as hard as the steel surfaces, prevent the two steel surfaces from touching each other. That reduces the wear of the suspension rope 3 and also the rope grooves of the traction sheave 4. The slip plane 12, which actually represents a slip surface in this cross-sectional view, between the two surfaces is more or less curvilinear somewhere between the particles 10, and can change all the time. Instead two steel surfaces there could be other kind of metal pairs, for example a steel surface and a cast iron surface. The teaching of FIG. 5. is schematic and thus there should not be direct conclusions from the dimensions of the particles, asperities of the surfaces or their distances or slip line. Also should be understood that there actually could be several slip lines between the surfaces.

The inventor believes that the lubrication performance of the lubricant 8 according to the invention is that the more or less spherically shaped hard particles 10 of the powder substance form a layer between the sliding and/or rolling surfaces of the suspension rope 3 and traction sheave 4, which layer prevents the contact between surface asperities. At the same time the particles 10 form a complex slip plane 12, which is not easily sheared and thus increases the friction but at the same time reduces wear of the surfaces. Due to their more or less spherical shape the hard particles 10 do not cause abrasive wear. Because of the different sizes of the particles 10 they can lock each other effectively in a dynamic contact situation between the contact surfaces.

The powder substance of the lubricant 8 should be rather fine. Advantageously the particle size of the powder substance is below 75 μm. Preferably at least 50% of mass of the powder substance of the lubricant 8 belongs to the particle size range from 1 to 10 μm.

The size distribution of the particles 10 is preferably such that a part of the particles 10 are greater than the asperity of the surfaces of the suspension rope 3 and the groove of the traction sheave 4. For example, one possible size distribution of the particles 10 is as follows: the powder substance contains 0% particles greater than 63 μm, 1% particles between 20 and 63 μm, 16% particles between 6.3 and 20 μm, 63% particles between 2 and 6.3 μm, and 20% particles smaller than 2 μm. Other size distributions with other particle sizes and percent distributions are also possible. A part of the particles 10 are smaller than the asperity of the surfaces of the suspension rope 3 and the groove of the traction sheave 4. In case of greater proportion of small particles, the total surface area of the particles being in contact with oil is larger.

It is clearly verified by the tests described above that, owing to the high proportion of powder-like powder substance with hard and more or less spherical particles 10 contained in the lubricant 8, the lifetime of an elevator suspension rope 3 lubricated with the lubricant 8 is considerably longer than the lifetime of elevator ropes lubricated with prior-art lubricants, and in addition the friction factor between the rope 3 and the traction sheave 4 is greater than when using conventional lubricants, which enables more advantageous dimensioning.

One characteristic aspect, among others, of the elevator according to the invention is that the elevator is provided with suspension ropes 3 that are lubricated with the lubricant 8 that contains the powder substance with hard solid particles 10 mentioned above, and the load-bearing material of the suspension ropes 3 is metal, e.g. steel. The whole mass of the lubricant 8 comprises a suitable aforesaid percentage of the powder substance with the substantially hard and substantially spherical particles 10. In addition, the lubricant 8 can contain the aforementioned binder agents and other additives.

The use of the aforementioned lubricant 8 that contains powder substance for lubricating a rope laid from metal wires 9 is further characteristic for the solution according to the invention.

It is obvious to the person skilled in the art that different embodiments of the invention are not only limited to the examples described above, but that they may be varied within the scope of the claims presented below. Thus, for example, the composition of the lubricant and the mixture ratio of the different constituents can also be different to what is described above.

Likewise, it is obvious to the person skilled in the art that instead of synthetic oil, mineral oils or vegetable oils suited to the purpose can also be used as an oil in the lubricant.

Further, the invention would easily be carried out within the teaching of the following items:

Item 1. Steel wire rope comprising one or more strands composed of steel wires and a lubricant, which lubricant comprises oil and an amount of a powder substance, the lubricant is in a form of paste and the powder substance in the lubricant comprises particles whose internal aspect ratio is at most about 5, preferably less than 2, more preferably less than 1.5, even more preferably at most about 1.2, most preferably as close to one as possible.

Item 2. Steel wire rope of item 1, in which the shape of the particles is substantially spherical or almost spherical.

Item 1a. Steel wire rope comprising one or more strands composed of steel wires and a lubricant, which lubricant comprises oil and an amount of a powder substance, the lubricant is in a form of paste and the powder substance in the lubricant comprises particles whose hardness is greater than 4 on the Mohs scale.

Item 2a. Steel wire rope of item 1a, in which the hardness of the particles is about equal to the hardness of the steel of the wires of the strands, or greater than the hardness of the steel of the wires of the strands.

Item 3. Steel wire rope of item 1, in which the powder substance in the lubricant (8) comprises particles (10) whose hardness is greater than 4 on the Mohs scale.

Item 4. Steel wire rope of item 1, in which the hardness of the particles is about equal to the hardness of the steel of the wires of the strands, or greater than the hardness of the steel of the wires of the strands.

Item 5. Steel wire rope of item 1 or item 1a, in which the powder substance comprises particles that belong to the spinel group of minerals, which has crystal forms that are cubic or isometric, for instance octahedral.

Item 6. Steel wire rope of item 1 or item 1a, in which the powder substance comprises classified manganese (II, III) oxide, $Mn_3O_4$ and/or manganese (IV) oxide, $MnO_2$.

Item 7. Steel wire rope of item 6, in which the powder substance is classified manganese (II, III) oxide, $Mn_3O_4$ and/or manganese (IV) oxide, $MnO_2$.

Item 8. Steel wire rope of item 1 or item 1a, in which the powder substance comprises glass balls and/or glass beads, and/or other substantially spherical or almost spherical material particles, such as ceramic particles.

Item 9. Steel wire rope of item 1 or item 1a, in which the particle size of at least some of the particles is greater than the asperity of the contact surface of the suspension rope and the counter contact surface of the suspension rope.

Item 10. Steel wire rope of item 1 or item 1a, in which advantageously the size of particles of the powder substance in the lubricant is smaller than 75 μm.

Item 11. Steel wire rope of item 9 or item 10, in which preferably at least 50% of the mass of the powder substance belongs to the particle size range from 1 to 10 μm.

Item 12. Steel wire rope of item 9 or item 10 or item 11, in which the more or less spherically shaped hard particles (10) of the powder substance are arranged to form a layer between the sliding and/or rolling contact surface of the suspension rope (3) and the counter contact surface of the suspension rope (3), which layer prevents the contact between surface asperities, and that the particles (10) are arranged to form a complex slip plane (12), which increases the friction but at the same time reduces wear of the contact surfaces.

Item 13. Steel wire rope of item 1 or item 1a, in which the lubricant comprises a binder agent, the proportion of the binder agent being in the range of 0-5 weight-%, preferably in the range of 0.2-3 weight-%, even more preferably in the range of 0.3-0.6 weight-%, and more suitably about 0.4 weight-% of the amount of the lubricant.

The invention claimed is:

1. A paste lubricant between a steel wire rope and a rope groove of a pulley, wherein the paste lubricant comprises oil and small solid particles, the small solid particles being of a wide variety of sizes, and being small enough to at least partly fit into valleys between peaks of surface roughness of the steel wire rope or the rope groove, and wherein the small solid particles comprise particles whose hardness is greater than 4 on the Mohs scale, or equal to or greater than the hardness of the steel of the wires of the strands of the rope.

2. A paste lubricant applied in a contact between a steel wire rope and a rope groove of a pulley, the paste lubricant comprising particles and oil, a surface structure of steel wires of the steel wire rope comprises a wire surface asperity and a surface of the rope groove comprises a groove surface asperity, the paste lubricant compressed in a space between the steel wires and the rope groove, the particles transmitting at least part of a shear force resulting from slip between the surface of the rope groove and the surface structure of the steel wires of the steel wire rope, wherein particles in the lubricant have hardness of greater than 4 on the Mohs scale, or equal to or greater than the hardness of the steel of the wires of the strands of the rope, and substantially are smaller than 5 times of an Ra-value of a rougher one of the surface structure of the steel wires and the surface of the rope groove, and wherein at least 80 percent of a total mass of the particles in the lubricant consists of particles larger than one tenth (1/10) of an Ra-value of a smoother one of the surface structure of the steel wires and the surface of the rope groove.

3. The paste lubricant according to claim 1, wherein a major part of the particles is harder than a softer one of the surface structure of the steel wires and the surface of the rope groove.

4. The paste lubricant according to claim 1, wherein the paste lubricant comprises particles having an internal aspect ratio of at most about 5.

5. The paste lubricant according to claim 1, wherein a shape of the particles is substantially spherical or almost spherical.

6. The paste lubricant according to claim 1, wherein an elastic modulus of the particles is in a range of from 50 GPa to 420 GPa.

7. The paste lubricant according to claim 6, wherein that the elastic modulus of the particles is in a range of from 80 GPa to 160 GPa.

8. The paste lubricant according to claim 1, wherein at least 5 percent of a total mass of the particles in the paste lubricant consists of particles smaller than one tenth (1/10) of an Ra-value of a smoother one of the surface structure of the steel wires and the surface of the rope groove.

9. The paste lubricant according to claim 1, wherein an Ra-value of roughness of the surface structure of the steel wires and/or the surface of the rope groove is in a range of 0.3-2.5 μm.

10. The paste lubricant according to claim 1, wherein a particle size in the paste lubricant is in a range of 0.1-8 μm, and particles of the paste lubricant are of different sizes.

11. The paste lubricant according to claim 1, wherein a median of a particle size distribution in the paste lubricant is in a range of 0.3-4 μm.

12. The paste lubricant according to claim 1, wherein, in the paste lubricant, mass portions as a function of particle size follows Weibull distribution or normal distribution.

13. The paste lubricant according to claim 2, wherein a major part of the particles are harder than a softer one of the surface structure of the steel wires and the surface of the rope groove.

14. The paste lubricant according to claim 1, wherein the paste lubricant comprises particles having an internal aspect ratio of at most about 5, and less than 2.

15. The paste lubricant according to claim 1, wherein the paste lubricant comprises particles having an internal aspect ratio of at most about 5, and less than 1.5.

16. The paste lubricant according to claim 1, wherein the paste lubricant comprises particles having an internal aspect ratio of at most about 1.2.

17. The paste lubricant according to claim 1, wherein an elastic modulus of the particles is in a range of from 70 GPa to 200 GPa.

18. The paste lubricant according to claim 1, wherein an Ra-value of roughness of the surface structure of the steel wires and/or the surface of the rope groove is in a range of 0.8-1.6 μm.

19. The paste lubricant according to claim 1, wherein a median of a particle size distribution in the paste lubricant is in a range of 1-3 μm.

20. The paste lubricant according to claim 2, wherein the paste lubricant comprises particles having an internal aspect ratio is at most about 5.

* * * * *